US012024836B2

(12) United States Patent
Farmer

(10) Patent No.: US 12,024,836 B2
(45) Date of Patent: Jul. 2, 2024

(54) PET WASTE COLLECTION DEVICE

(71) Applicant: OTB Concepts LLC, Tempe, AZ (US)

(72) Inventor: William Cannon Farmer, El Paso, TX (US)

( * ) Notice: Subject to any disclaimer, the term of this patent is extended or adjusted under 35 U.S.C. 154(b) by 975 days.

(21) Appl. No.: 17/007,319

(22) Filed: Aug. 31, 2020

(65) Prior Publication Data

US 2021/0079607 A1 Mar. 18, 2021

Related U.S. Application Data

(60) Provisional application No. 62/894,786, filed on Sep. 1, 2019.

(51) Int. Cl.
*E01H 1/12* (2006.01)

(52) U.S. Cl.
CPC ..... *E01H 1/1206* (2013.01)

(58) Field of Classification Search
CPC ..... E01H 1/1206; E01H 2001/1293; A01K 23/005
USPC ..... 294/1.4
See application file for complete search history.

(56) References Cited

U.S. PATENT DOCUMENTS 3,431,008 A * 3/1969 Narita ..... E01H 1/1206 294/1.4
4,148,513 A * 4/1979 Gagne ..... E01H 1/1206 15/257.1
4,221,415 A 9/1980 Ganz
4,705,310 A 11/1987 Scripter
4,896,912 A 1/1990 Parnell
4,958,871 A 9/1990 Hemans
5,039,149 A 8/1991 Gish
5,400,572 A 3/1995 Peck
5,503,442 A 4/1996 Lee
5,540,470 A * 7/1996 Lu ..... E01H 1/1206 294/1.4
5,899,510 A 5/1999 Hayes
6,039,370 A 3/2000 Dooley, Jr.
6,086,123 A 7/2000 Sowinski
6,095,579 A * 8/2000 Nichols ..... E01H 1/1206 294/1.3
6,126,215 A 10/2000 Jahns
(Continued)

*Primary Examiner* — Paul T Chin
(74) *Attorney, Agent, or Firm* — James L Farmer

(57) ABSTRACT

Method and apparatus are provided for a pet waste collection device. In one embodiment the device includes an elongated handle extending from a grip at an upper end of the handle to a bracket at a lower end thereof. A housing is pivotally connected at a first end thereof to a main pivot on the bracket and extends away from the handle to a second end. The device may further include a leg extending from the housing proximate the housing second end to a foot at a lower end of the leg, and a waste receptacle connected to the bracket opposite the housing. A scoop has a pivot end and a scooping end, with the pivot end connected to a spool rotatably mounted inside the housing proximate the housing second end, wherein the scoop is rotatable from a scooping position in which the scoop extends downward, to a dumping position in which the scooping end is juxtaposed with the waste receptacle. The device may further include a torsion coil spring disposed within the housing and configured to wind or unwind upon rotation of the scoop about the housing. A flexible tension member connects the spool to the bracket.

20 Claims, 6 Drawing Sheets

(56) References Cited

U.S. PATENT DOCUMENTS

| | | | | |
|---|---|---|---|---|
| 6,135,520 | A * | 10/2000 | Miller | E01H 1/1206 294/1.4 |
| 6,227,149 | B1 | 5/2001 | Host | |
| 6,386,606 | B1 | 5/2002 | Marshall | |
| 6,485,073 | B2 | 11/2002 | Harrison | |
| 6,648,387 | B2 | 11/2003 | Kaplan | |
| 6,702,349 | B2 | 3/2004 | Clements | |
| 6,942,264 | B1 | 9/2005 | Mendez | |
| 7,188,878 | B1 | 3/2007 | Kraus | |
| 7,401,826 | B1 | 7/2008 | Marrett | |
| 7,448,659 | B1 | 11/2008 | Auseklis | |
| 7,618,073 | B2 | 11/2009 | Casper | |
| 7,870,835 | B2 | 1/2011 | Amerena | |
| 8,201,862 | B2 | 6/2012 | Langley | |
| 8,449,007 | B2 * | 5/2013 | Farmer | E01H 1/1206 294/1.4 |
| 8,905,446 | B2 * | 12/2014 | Farmer | E01H 1/1206 294/1.4 |
| 11,713,549 | B2 * | 8/2023 | Bartz | A01K 23/005 294/1.4 |
| 2008/0048463 | A1 | 2/2008 | Selenke | |

* cited by examiner

FIG. 4
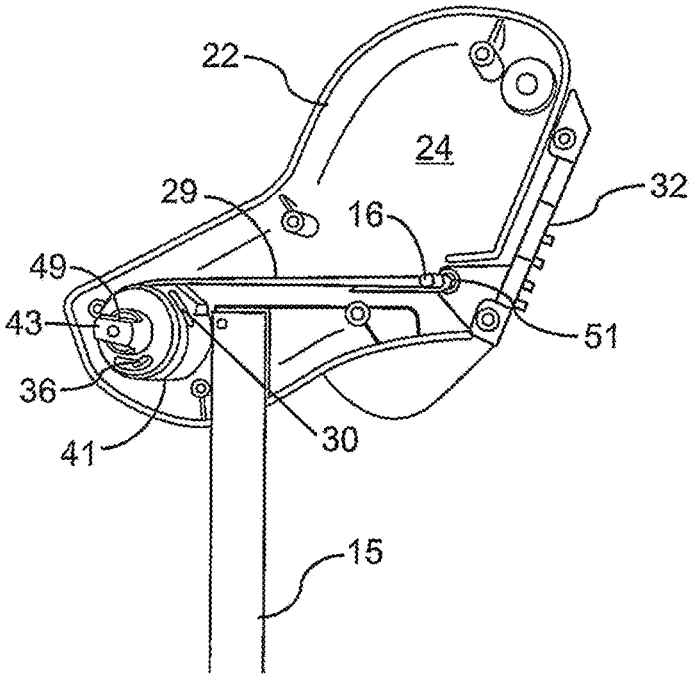
FIG. 5
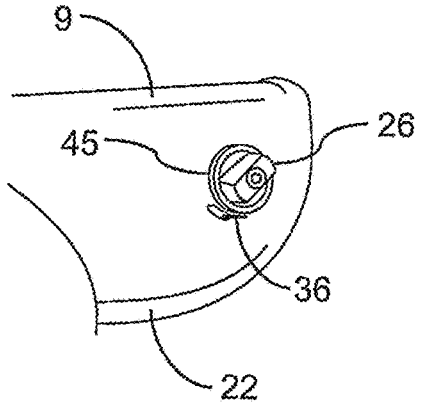
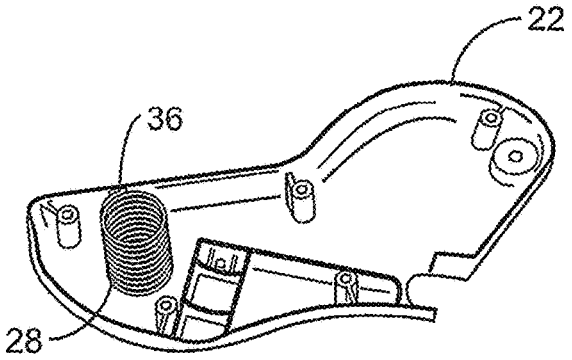
FIG. 6
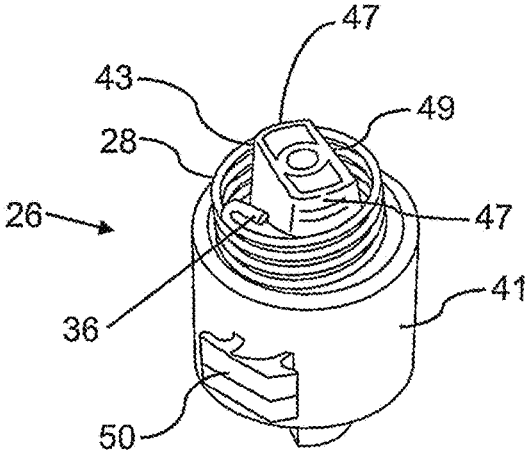
FIG. 7

PET WASTE COLLECTION DEVICE

TECHNICAL FIELD AND BACKGROUND

Provisional Patent Application Ser. No. 62/894,786, to which the present application claims priority, is hereby incorporated by reference. The present invention generally relates to devices for collecting and disposing of waste material, and more particularly relates to hand-held mechanical devices for removing animal excrement from lawns, landscaping, and other inhabited areas.

BRIEF DESCRIPTION OF THE DRAWINGS

In the accompanying drawings:

FIG. 4 is a left side view of an exemplary waste collection device without the handle, bucket, scoop, and the left side of the housing;

FIG. 5 is a right side view of the front of the housing portion of the waste collection device without the scoop;

FIG. 6 is a perspective view of the inside of the right side of the housing portion of the waste collection device showing the spring;

FIG. 7 is a perspective view of the spool and spring;

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
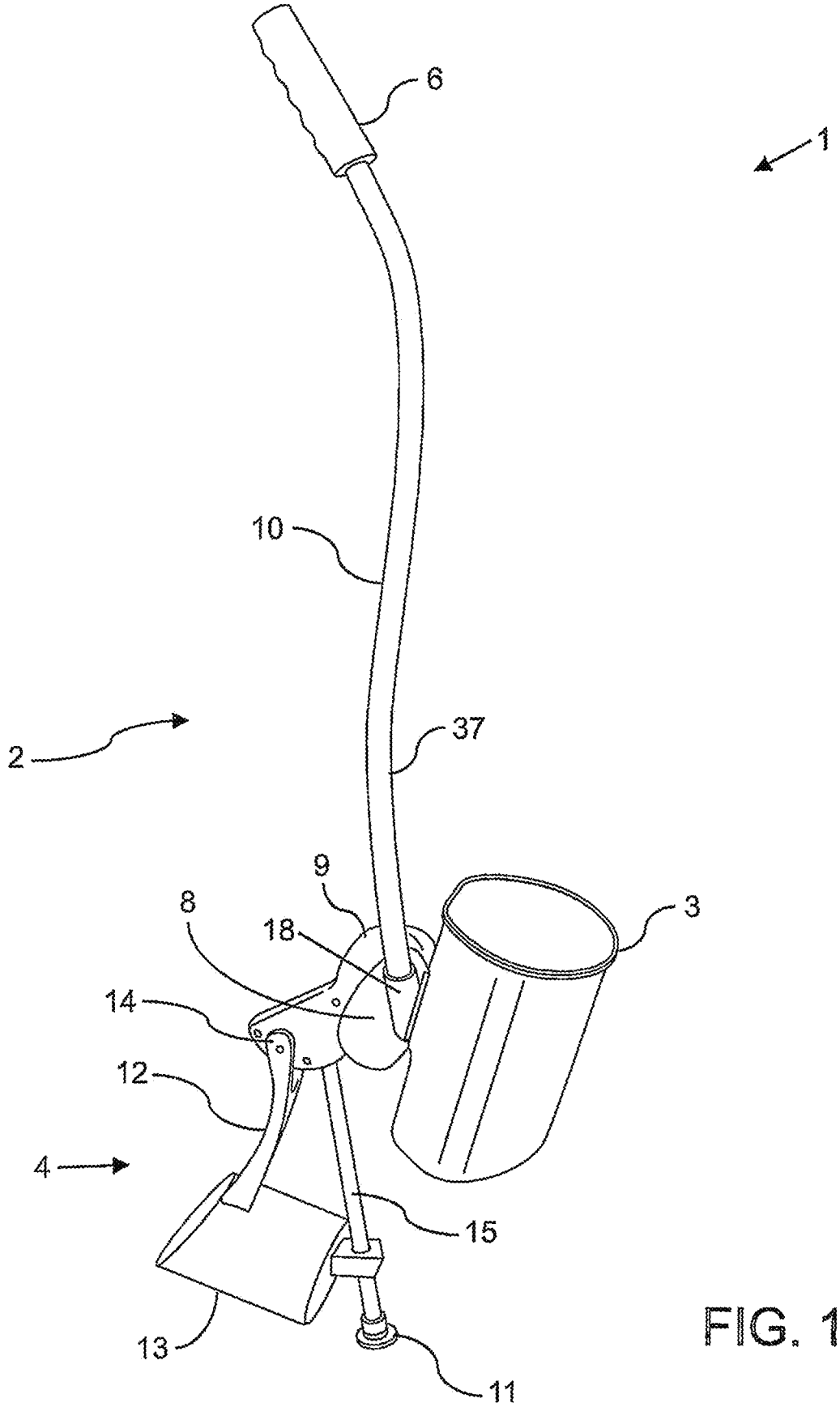
FIG. 1 is a perspective view of an exemplary waste collection device in accordance with the present disclosure.
Figure 2:
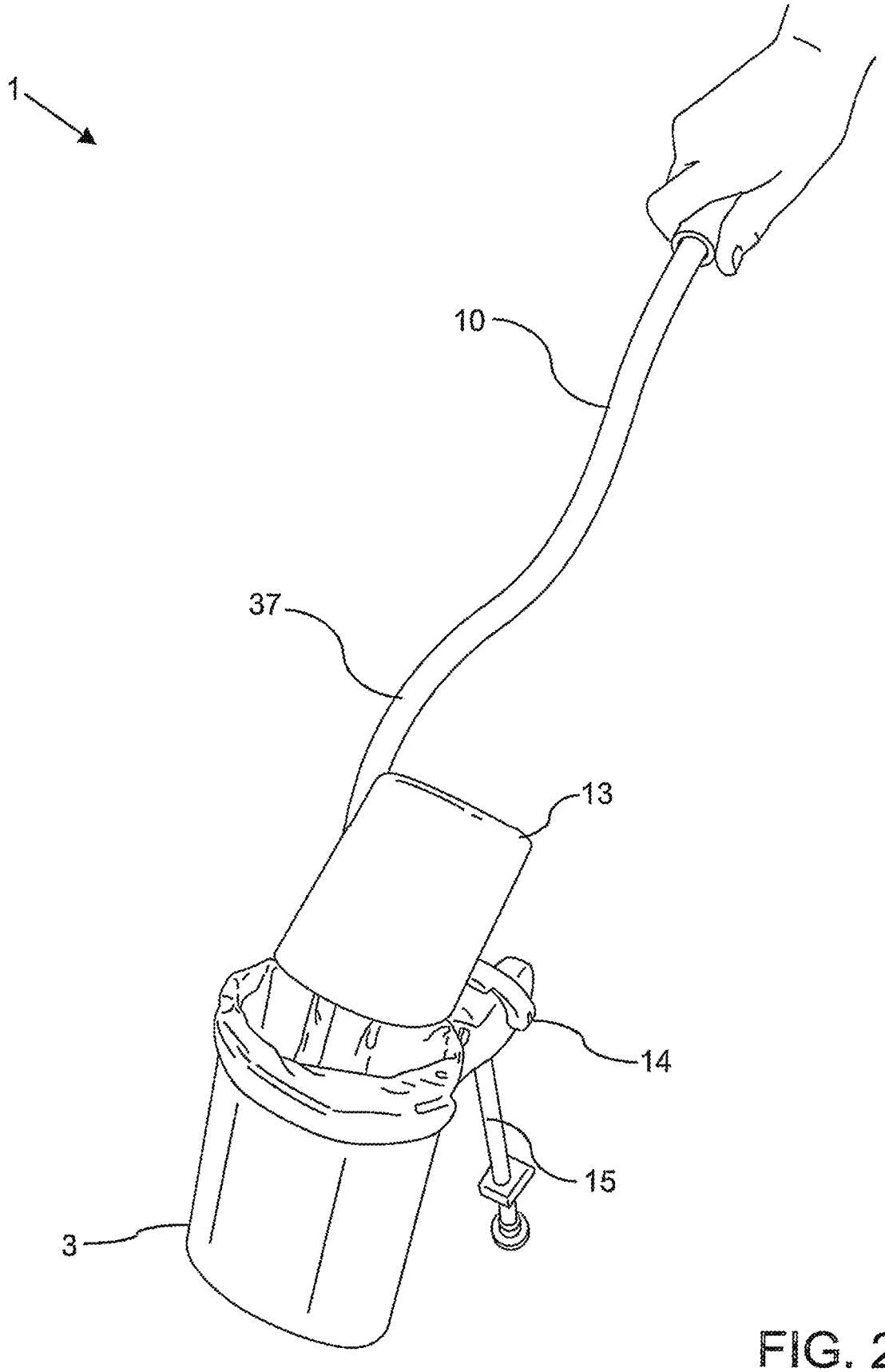
FIG. 2 is another perspective view of the waste collection device of FIG. 1 with the scoop in the dumping position.
Figure 3:
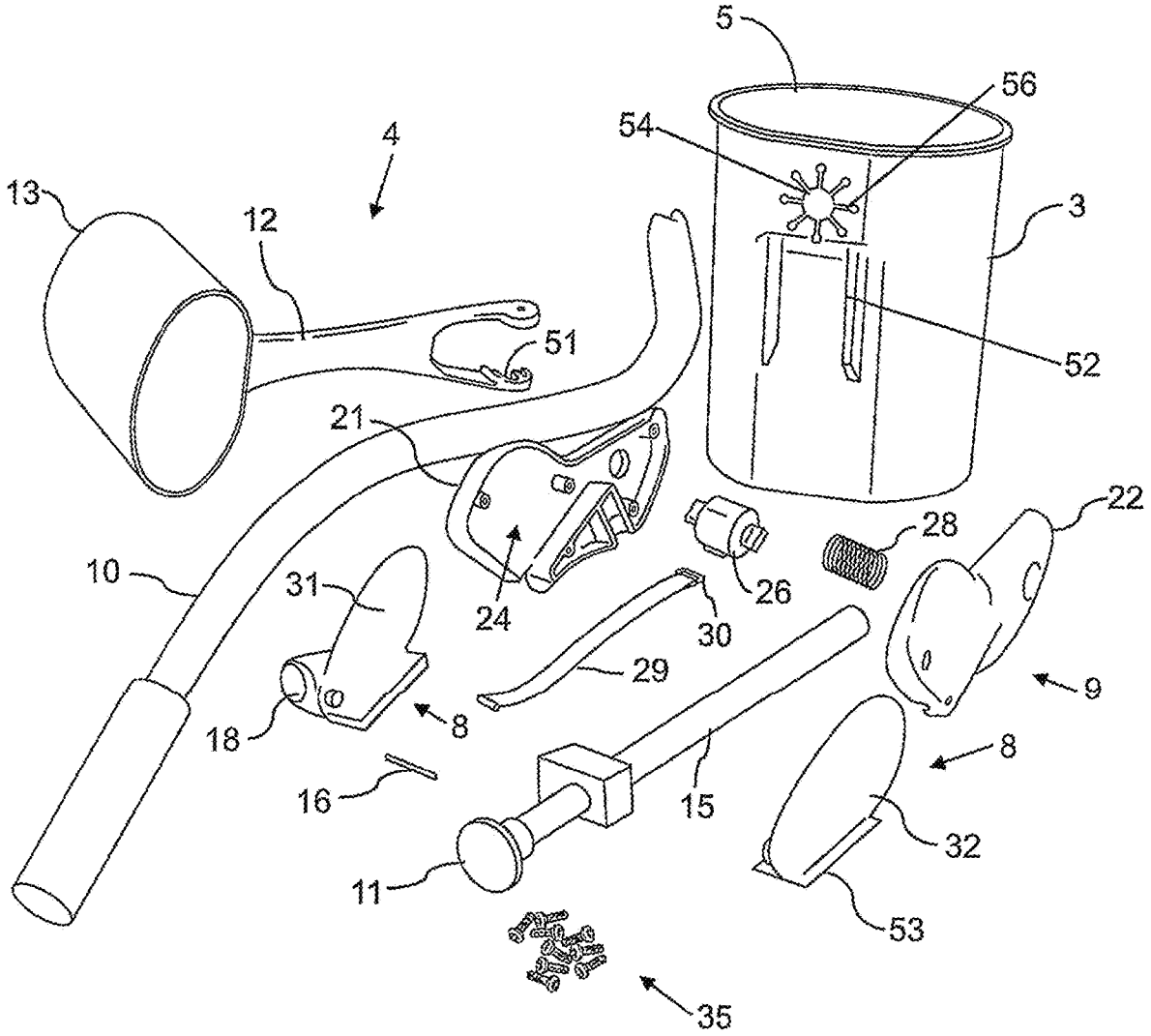
FIG. 3 is an exploded view of the waste collection device of FIG. 1.

Referring specifically to the drawing figures, an exemplary waste collection device in accordance with the present disclosure is shown in FIGS. 1 through 3, and indicated generally at reference numeral 1. The waste collection device 1 comprises a frame 2, a waste receptacle 3, and a pivoting scoop 4. The waste receptacle 3 is an open ended container, such as for example a flexible basket, or a rigid canister as illustrated. Receptacle 3 may comprise an integral portion of the frame 2, or an independent element permanently or detachably connected to the waste collection device. In one exemplary embodiment shown in FIG. 2, waste receptacle 3 is supported by a main pivot bracket 8 that forms an integral portion of the frame 2. The frame 2 further includes a rigid handle 10 that extends from a grip end 6 to handle socket 18 in bracket 8, a housing 9 pivotally connected at a first end thereof to main pivot bracket 8, and a leg 15 extending down from a second end of housing 9 to a foot 11.

Figure 11:
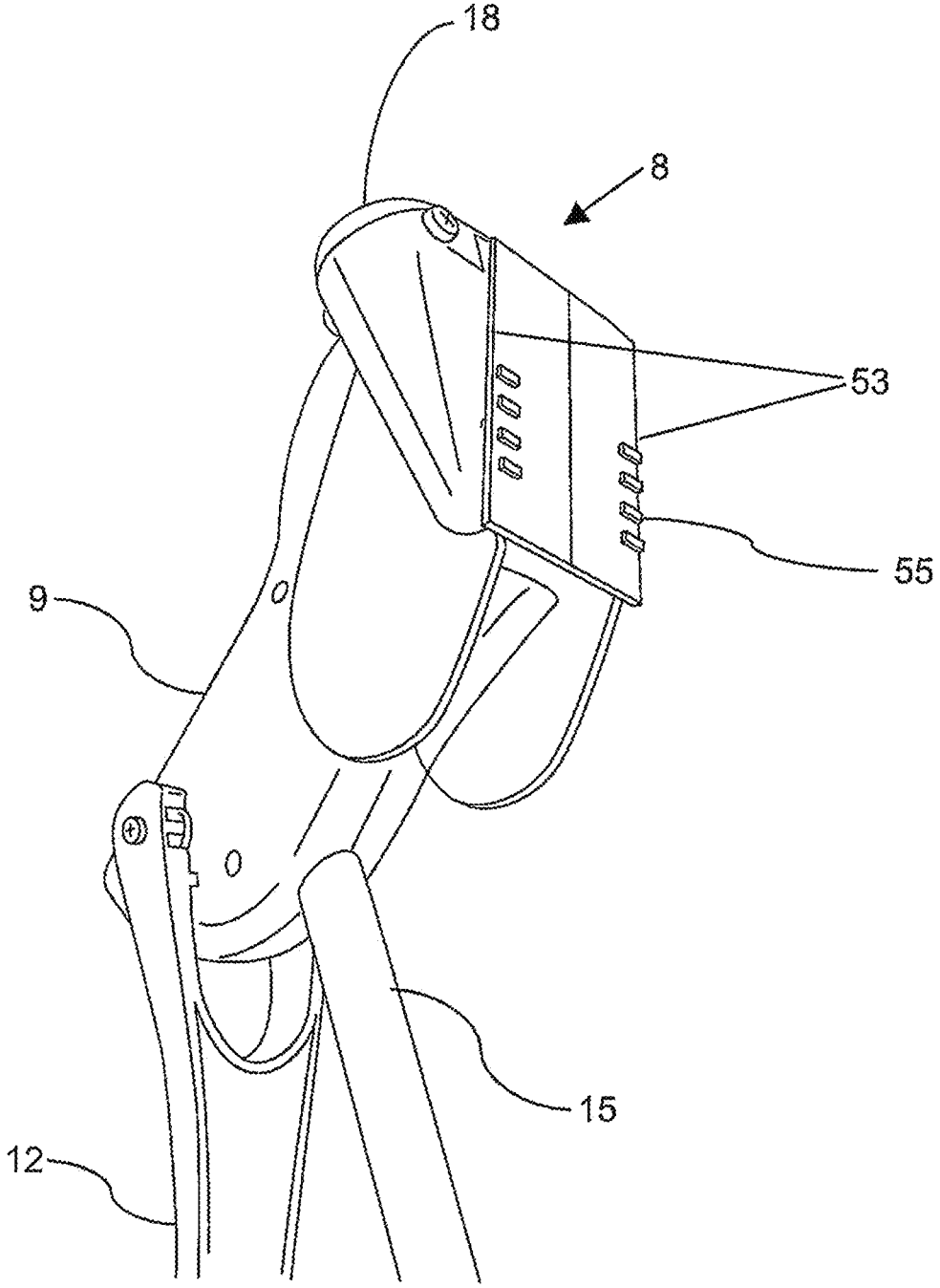
FIG. 11 is back, upward perspective view of a portion of the waste collection device showing the waste receptacle mounting flanges.

The waste receptacle may be permanently or detachably mounted to the back of the main pivot bracket 8. In the depicted embodiment the receptacle is detachable and has an integral slot 52 configured to receive receptacle flanges 53 on bracket 8. The receptacle is installed by positioning an upper end of flanges 53 in a lower end of slot 52, and then sliding the receptacle downward. The fit of the flanges in the slot may be tight enough to hold the receptacle in place by friction. As best seen in FIG. 11, one or more detents such as bumps 55 may also be provided that increase friction or snap into place at the end of the downward sliding motion to lock the receptacle in place.

Referring to FIG. 3, a bag retention hole 54 is provided in an upper portion of the receptacle near the rim 5. Hole 54 may include radial slots 56 that extend away from the hole to enhance flexibility of the receptacle material around the hole. In practice a plastic bag liner is placed in the receptacle with the open end of the bag folded over the rim 5 and overlapping the sides. Excess bag is gathered and tucked into hole 54 using a finger until the bag is snug around the receptacle.

The scoop 4 comprises a scooping surface, such as for example a shovel, or the bottom side of the depicted open-ended cup 13, adapted to be slid underneath a waste material deposit. The scooping surface may be at the lower end of a scoop arm 12 that is pivotally connected to the waste collection device. In the depicted embodiments the scoop 4 is pivotally connected directly to frame 2 at a scoop pivot joint 14. The cup 13 and scoop arm 12 may be one integral molded part, or separate elements fastened or bonded together. The scoop 4 is rotatable about the pivot joint 14 from a loading position, as shown in FIG. 1 with the scoop extended generally downward and away from grip end 6, to a dispensing position as shown in FIG. 2 where the scoop has rotated about pivot joint 14 to a position with the opening of cup 13 directly juxtaposed, or partially inside the open end of receptacle 3.

The frame and other parts of the collection device may be constructed of various rigid, lightweight materials and products, such as for example aluminum tubing joined together with rivets or welds, or molded plastic. The particular cross-section shapes, sizes, thicknesses, and material selections may vary from one portion of the device to another as needed to achieve an optimal combination of strength, weight, and functionality. For example, the handle 10 may comprise a relatively rigid plastic material that is stiffer than another more flexible plastic material used for the receptacle 3. In one embodiment the handle 10 is aluminum tubing.

Continuing now with FIG. 3, the housing 9 may comprise a left half 21 and a right half 22 that when assembled create a hollow structure with an inner cavity 24 containing a spool 26, return spring 28, and a strap 29. The housing halves may be injection molded from a structural plastic such as ABS. The main pivot bracket 8 may also be a two piece construction, with a left half 31 and right half 32 joinable using any suitable method such as with screws 35. Left and right halves 31, 32 may also be molded from a structural plastic.

Referring to FIGS. 4 through 7, the spool 26 has a barrel 41 disposed about an axle 43 that is rotatably received in, and projects through journals 45 formed in the housing halves. The axle 43 has circular bearing surfaces 47 that align with and bear against the housing journals 45. The bearing surfaces are configured to allow the spool to rotate freely inside the housing when the housing halves are screwed together. A spline 49 at each end of the axle 43 fits into slots 51 (see FIG. 3) formed in the ends of scoop arm 12, thereby rotationally locking the spool to the scoop so that the spool and scoop rotate as a unit. The spool 26 and journals 45 thus provide the scoop pivot 14 noted previously.

The return spring 28 fits around the axle 43 of spool 26 in a cylindrical annulus between the axle and an inside surface of barrel 41. Hooks 36 at the ends of the spring connect one end to the barrel as shown in FIG. 4, and the other end to the housing right side 22 as shown in FIG. 5. Thus, rotating the spool 26 causes the spring 28 to wind or unwind, depending on the direction of rotation. In the depicted embodiment, the spring is configured such that rotating the spool clockwise as viewed from the perspective of FIG. 4 causes the spring to wind up. The spring is configured to allow the spool to be rotated at least one complete revolution without the spring binding inside the spool.

The spool 26 is also configured to connect to and wind up the strap 29. In the depicted embodiment a rigid ring 30 at one end of strap 29 connects to a flange 50 on the outside of the barrel 41 of spool 26. The ring may be square and made of steel wire, or similar construction. The strap 29 is connected to the spool by snapping the ring 30 under the flange 50, trapping the ring against outside of barrel 41. The flange 50 may include a detent to prevent the ring from moving once snapped in place under the flange. A loop at the other end of the strap receives a steel pin 16 that is secured inside main pivot bracket 8 by sockets 51, thereby connecting the strap to the main pivot bracket. The main pivot bracket 8 is pivotally connected to the housing 9 at main pivots 33, one on each side.

Figure 8A:
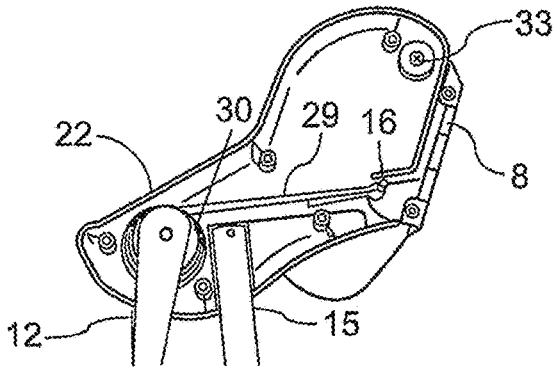
FIGS. 8A and 8B are left side views of the waste collection device with the handle and left side of the housing removed, and the scoop in the scooping position.
Figure 8B:
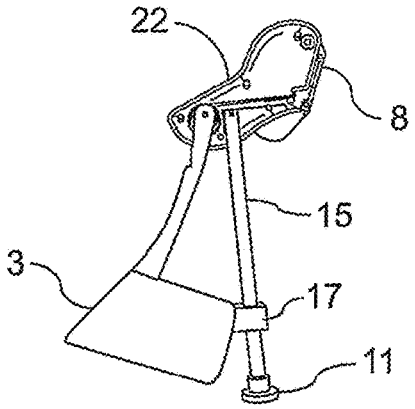

FIGS. 8 through 10 illustrate relative positions of the above described elements as the waste collection device transitions from a scooping position to a dumping position. In FIGS. 8A and 8B the device is in the scooping position, with the scoop 4 rotated all the way downward until the back of the cup 13 is proximate a bumper 17 on leg 15. In this position the spool has rotated counter-clockwise under the counter-clockwise torque being applied by the return spring 28, in the process winding the strap around the barrel and pulling the lower end of main bracket 8 toward the spool in a pivoting motion about main pivots 33 until the front of the bracket bottoms out against a back edge of the housing 9. The spring 28 may be pre-wound with enough turns before connecting both ends of the strap so that when the device is in the scooping position the spring is still able to apply enough torsion bias to the spool to tend to maintain the scoop against the bumper 17. The spring bias also tends to cause the device to naturally return to and stay in the scooping position when no external force is being applied to the handle 10 or leg 15. Thus the device will generally stay in the scooping position when not in use, or when being positioned to scoop a waste deposit.

Figure 9A:
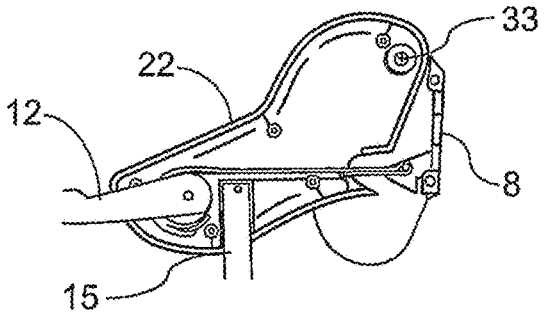
FIGS. 9A and 9B are left side views of the waste collection device with the handle and left side of the housing removed, and the scoop rotated upward to a position approximately midway between the scooping and dumping positions.
Figure 9B:
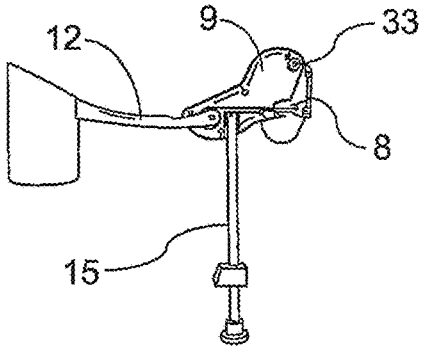

In FIGS. 9A and 9B the scoop 4 is shown rotated up approximately half way to the dumping position. In this transition position the strap has partially unwound from the spool, as can be seen by comparing the position of the ring 30 in FIG. 9A vs FIG. 8A, and the main bracket has pivoted away from the back of the housing. However the resulting clockwise rotation of the spool tends to wind and tighten the spring. In order for that to happen the main bracket 8 must be pivoted rearward with enough force or torque to pull strap 29 hard enough to overcome the counterclockwise torque being applied to the spool by the spring. In practice this is done by pushing downward on the handle while the device 1 is held in a generally vertical orientation, and the foot 11 of leg 15 is on the ground. As can be seen, the handle is horizontally offset from the leg, producing a couple that applies the necessary counterclockwise torque to the main bracket 8 when the handle is pushed downward. The amount of torque and the resulting rotation speed of the scoop can be controlled by simply moderating the handle pressure.

Figure 10A:
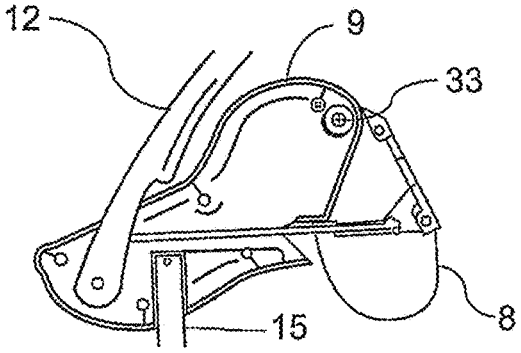
FIGS. 10A and 10B are left side views of the waste collection device with the handle and left side of the housing removed, and the scoop in the dumping position.
Figure 10B:
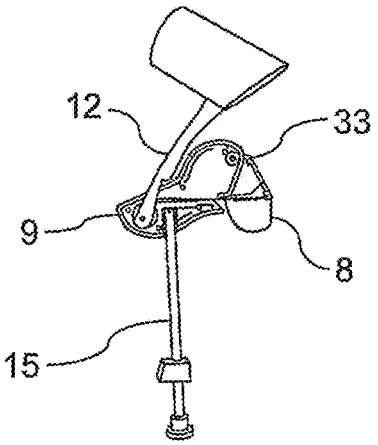

In FIGS. 10A and 10B the scoop has rotated all the way up and around to the dumping position, as also shown from another angle in FIG. 2. In this position the scoop arm 12 has bottomed out against either the housing 9 or the waste receptacle 3, thus acting as a stop to prevent any further unwinding of the strap from the spool. In a preferred embodiment at least some portion of the strap is still wrapped around and in contact with the barrel. The scoop can be rotated to the dumping position by a continuation of the downward pressure on the handle discussed above causing the scoop to move smoothly from the scooping position to the dumping position.

Collecting waste material with the waste collection device involves generally two actions: scooping the waste material into the cup 13; and dispensing the material from the cup into the receptacle 3. In order to initiate the process, the collection device must first be in the scooping position. The collection process begins by holding the device at grip end 6, with the open end of cup 13 close to, or touching the ground immediately behind and facing the waste material to be collected. From this position the scoop is moved forward, toward the waste material, and slid quickly underneath it in one motion, scooping the waste material into the cup 13. If the waste material is on a soft surface such as grass, it may facilitate scooping to press the cup slightly downward into the surface while scooping.

Once the scooping action is completed and the waste material is entirely inside the cup 13, the waste material can be dispensed into the waste receptacle 3. Dispensing involves rotating the scoop 4 about pivot 14 in the manner described above until it reaches the dumping position. The rotation is best done in one continuous motion until the cup reaches the receptacle, at which point the rotation is abruptly halted by contacting the housing 9 or the top of the receptacle 3. When the scoop stops, inertia causes the waste material to slide out of the cup and directly into the receptacle 3. By easing off the downward handle pressure the scoop can then be rotated back down to the scooping position, and the process repeated.

Although the waste collection device may be effectively used to scoop waste off the ground and into the cup 13 in the above described manner, the present invention contemplates and may incorporate the use of a spade or rake of the type associated with prior art dust pan and rake refuse collectors to assist with the scooping step. Advantageously the waste collection device of the present invention is intended to be operated using only one hand. The operator's other hand is therefore available should the need arise, for whatever reason, to use a spade or similar tool to help push the waste material into the scoop. Such a pushing tool could be detachably connected to the frame for easy access only when needed.

The receptacle 3 of waste collector 1 may also be used in conjunction with disposable liner, such as a plastic bag. For example, a plastic bag, such as the ubiquitous pet waste bags sold in rolls, can be placed inside the receptacle prior to or after attaching the receptacle to the waste collector. After use, the bag may be pulled out of the receptacle by the clean, open end, for disposal.

Although the handle 10 is offset in a direction away from spool 26 and leg 15 as discussed above for creating the torque needed to rotate the scoop, the grip end and lower end of the handle where it attaches to the main bracket are generally both aligned with the spool and leg in a lateral direction. However, as the scoop rotates toward the dumping position, the cup 13 must pass by a lower portion of the handle. To accommodate that the handle has a bowed section 37 at the bottom, as best seen in FIGS. 1 and 2, where it curves laterally outward far enough to give clearance for the cup to pass by without touching the handle. The exact shape of the bowed section 37 is not critical, and it can be smoothly curved as shown, or alternatively comprised of straight sections and bends.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed is:

1. A pet waste collection device, comprising:

a frame comprising:

an elongated handle extending from a grip at an upper end of the handle to a lower end thereof, the upper and lower ends defining points on a handle axis;

a housing pivotally connected at a first end thereof to the lower end of the handle, the housing extending away from the handle axis to a second end; and a leg extending from the housing proximate the housing second end to a foot at a lower end of the leg;

a waste receptacle connected to the frame proximate the lower end of the handle and opposite the housing, the waste receptacle having an upward facing open end;

a scoop with a pivot end and a scooping end, the pivot end connected to a spool rotatably mounted inside the housing proximate the housing second end, wherein the scoop is rotatable from a scooping position in which the scoop extends downward substantially away from the handle and adjacent the leg, to a dumping position in which the scooping end is juxtaposed with the open end of the waste receptacle;

a torsion spring disposed within the housing having a first end connected to the housing and a second end connected to spool, wherein rotating the scoop about the housing causes the spring to wind or unwind; and a flexible tension member with a first end connected to the spool, and a fixed end connected to the frame proximate the lower end of the handle.

2. The pet waste collection device of claim 1, wherein the handle axis, the housing, the leg and the scoop are all disposed substantially within in a single plane.

3. The pet waste collection device of claim 2, wherein the spool comprises a cylindrical barrel with an axel extending from left and right ends of the barrel through journals in housing defining a spool axis perpendicular to the single plane, and wherein the pivoting end of the scoop is connected to the axel.

4. The pet waste collection device of claim 3, wherein the housing comprises left and right halves joined together and defining an internal cavity.

5. The pet waste collection device of claim 4, wherein the torsion spring is disposed in an annular space between the axel and an inside surface of the spool barrel.

6. The pet waste collection device of claim 5, wherein the torsion spring is configured to rotationally bias the scoop from the dumping position toward the scooping position.

7. The pet waste collection device of claim 6, further comprising a bracket at lower end of the handle, wherein the first end of the housing is pivotally connected to a main pivot on the bracket.

8. The pet waste collection device of claim 7, wherein the waste receptacle is connected to the bracket.

9. The pet waste collection device of claim 1, wherein the pivot end of the scoop is at one end of an elongated arm, and the scooping end comprises a cup disposed at an opposite end of the arm.

10. The pet waste collection device of claim 9, wherein the arm comprises left and right sides at the pivot end that fit around the housing and connect to the spool axel on left and right sides of the housing.

11. The pet waste collection device of claim 7, wherein the flexible tension member is disposed in the cavity.

12. The pet waste collection device of claim 11, wherein a portion of the flexible tension member proximate the first end is wrapped around an outer surface of the spool barrel, and the fixed end of the flexible tension member is connected to the bracket at a position offset below the main pivot, such that rotating the housing about the main pivot changes a spacing between the spool and the fixed end of the flexible tension member, thereby causing the flexible tension member to wrap further or unwrap from the spool, and the spool to rotate.

13. The pet waste collection device of claim 12, wherein rotation of the housing about the main pivot in an upward direction toward the grip end of the handle causes the scoop to rotate toward the dumping position.

14. A method of scooping up and storing pet waste, comprising the steps of:

scooping up an article of pet waste from a surface with a scooping end of a scoop that is pivotally connected to a housing, the housing pivotally connected to an elongated handle, and substantially hollow defining an internal housing cavity;

positioning a lower end of a leg extending downward from the housing against the surface;

applying a downward pressure to the handle sufficient to overcome a torsional force being exerted by a spring inside the housing, causing the housing to rotate upward about the handle, and the scoop to rotate upward about the housing.

15. The method of claim 14, wherein the spring is disposed within a spool inside the cavity.

16. The method of claim 15, wherein a strap disposed in the cavity is wrapped around and attached to the spool at one end and connected to the handle at an opposite end, such that rotation of the housing upward causes the strap to unwind from the spool and the spool to rotate.

17. The method of claim 16, wherein the scoop is attached to the spool, and rotation of the housing upward causes the scoop to rotate upward about the housing, and the spring to wind up.

18. The method of claim 17, further comprising the step of applying continued downward pressure on the handle until the scoop rotates from a scooping position in which the scoop extends toward the surface substantially adjacent the leg, to a dumping position in which the scooping end is juxtaposed with an open upper end of a waste receptacle attached to the handle.

19. A pet waste collection device, comprising:

an elongated handle extending from a grip at an upper end of the handle to a bracket at a lower end thereof, the upper end and bracket defining points on a handle axis;

a housing pivotally connected at a first end thereof to a main pivot on the bracket, the housing extending away from the handle axis at an angle to a second end;

a leg extending from the housing proximate the housing second end to a foot at a lower end of the leg;

a waste receptacle connected to the bracket opposite the housing, the waste receptacle having an upward facing open end;

a scoop with a pivot end and a scooping end, the pivot end connected to a spool rotatably mounted inside the housing proximate the housing second end, wherein the scoop is rotatable more than one hundred and eighty degrees from a scooping position in which the scoop extends downward substantially away from the handle and adjacent the leg, to a dumping position in which the scooping end is juxtaposed with the open end of the waste receptacle;

a torsion coil spring disposed within the spool having a first end connected to the housing and a second end connected to spool, wherein rotating the scoop about the housing causes the spring to wind or unwind; and a flexible tension member with a first end connected to the spool, and a fixed end connected to the bracket at a position offset below the main pivot.

20. The pet waste collection device of claim 19, wherein the housing is made of two halves jointed together that define an internal cavity, and wherein the tension member and the spool are disposed within the cavity.

* * * * *